US009017423B2

(12) United States Patent
Burkinshaw et al.

(10) Patent No.: US 9,017,423 B2
(45) **Date of Patent: *Apr. 28, 2015**

(54) CLEANING METHOD

(71) Applicant: Xeros Limited, Leeds (GB)

(72) Inventors: Stephen Martin Burkinshaw, West Yorkshire (GB); Jane Howroyd, West Yorks (GB)

(73) Assignee: Xeros Limited, Rotherham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/163,170

(22) Filed: Jan. 24, 2014

(65) Prior Publication Data

US 2014/0137340 A1 May 22, 2014

Related U.S. Application Data

(63) Continuation of application No. 12/295,671, filed as application No. PCT/GB2007/001235 on Apr. 4, 2007, now Pat. No. 8,974,545.

(30) Foreign Application Priority Data

Apr. 7, 2006 (GB) ..... 0607047.8

(51) Int. Cl.

| | |
|---|---|
| ***D06L 1/16*** | (2006.01) |
| ***C11D 1/02*** | (2006.01) |
| ***C11D 1/38*** | (2006.01) |
| ***C11D 1/66*** | (2006.01) |
| ***C11D 3/60*** | (2006.01) |
| ***C11D 3/37*** | (2006.01) |
| ***C11D 17/06*** | (2006.01) |
| ***D06F 35/00*** | (2006.01) |
| ***C11D 11/00*** | (2006.01) |
| ***D06L 1/00*** | (2006.01) |

(52) U.S. Cl.

CPC ..... *D06F 35/006* (2013.01); *C11D 3/3719* (2013.01); *C11D 11/0017* (2013.01); *C11D 11/0023* (2013.01); *D06L 1/00* (2013.01); *D06L 1/005* (2013.01)

(58) Field of Classification Search

USPC ..... 8/137

See application file for complete search history.

(56) References Cited

U.S. PATENT DOCUMENTS

| | | | | |
|---|---|---|---|---|
| 4,374,443 | A | 2/1983 | Mosell | |
| 4,434,067 | A | 2/1984 | Malone et al. | |
| 4,575,887 | A * | 3/1986 | Viramontes | 8/158 |
| 4,801,333 | A | 1/1989 | Mosell | |
| 4,951,366 | A * | 8/1990 | Geller | 26/28 |
| 5,468,175 | A | 11/1995 | Nilen | |
| 5,601,480 | A | 2/1997 | Nilen | |
| 5,605,491 | A | 2/1997 | Yam et al. | |
| 5,667,431 | A | 9/1997 | Mortin | |
| 5,925,195 | A | 7/1999 | King et al. | |
| 6,235,705 | B1 | 5/2001 | Zembrodt et al. | |
| 7,070,489 | B2 | 7/2006 | Rogmark | |
| 7,498,294 | B2 | 3/2009 | Konno et al. | |
| 2002/0039976 | A1 | 4/2002 | Sebillotte-Arnaud et al. | |
| 2003/0134759 | A1 | 7/2003 | Geary et al. | |
| 2004/0171515 | A1 | 9/2004 | Hamers et al. | |
| 2005/0148479 | A1 * | 7/2005 | Barthel et al. | 510/101 |
| 2005/0153865 | A1 | 7/2005 | Detering et al. | |
| 2005/0183206 | A1 | 8/2005 | Brown et al. | |
| 2005/0183208 | A1 | 8/2005 | Sscheper et al. | |
| 2005/0204477 | A1 * | 9/2005 | Casella et al. | 8/115.51 |
| 2009/0217461 | A1 * | 9/2009 | Burkinshaw et al. | 8/137 |

FOREIGN PATENT DOCUMENTS

| | | |
|---|---|---|
| CA | 1284407 | 5/1991 |
| DE | 1 900 002 | 7/1970 |
| EP | 0171215 | 2/1986 |
| EP | 1371718 | 12/2003 |
| GB | 2302553 | 1/1997 |
| JP | 4241165 | 8/1992 |
| WO | WO 2006/040539 * | 4/2006 |

OTHER PUBLICATIONS

Translation JP 4-241165, Aug. 28, 1992.*

"Aqua Ball Set", Aug. 18, 2006, Auravita Limited, http://www.auravita.com/products/AURA/TAPR10610.asp.

"Capture Carpet Cleaning Kit", Basic Home Products, Aug. 11, 2005, http://www.basichomeshopping.com/CaptureCarpetCleanerKit.html.

"Capture Carpet Cleaning Kit", Home Sale.com Classifieds, Aug. 11, 2005, http://www.domesticsale.com/Classifieds/15175.html.

* cited by examiner

*Primary Examiner* — Amina Khan

(74) *Attorney, Agent, or Firm* — Clark & Elbing LLP

(57) ABSTRACT

The invention provides a method and formulation for cleaning a soiled substrate, the method comprising the treatment of the moistened substrate with a formulation comprising a multiplicity of polymeric particles, wherein the formulation is free of organic solvents. Preferably, the substrate is wetted so as to achieve a substrate to water ratio of between 1:0.1 to 1:5 w/w. Optionally, the formulation additionally comprises at least one cleaning material and, in this embodiment, it is preferred that the polymeric particles are coated with the at least one cleaning material. Preferably, the cleaning material comprises a surfactant, which most preferably has detergent properties. Most preferably, the substrate comprises a textile fiber. Typically, the polymeric particles comprise particles of nylon, most preferably in the form of nylon chips. The results obtained are very much in line with those observed when carrying out conventional dry cleaning processes and the method provides the significant advantage that the use of solvents, with all the attendant drawbacks in terms of cost and environmental considerations, can be avoided.

43 Claims, 4 Drawing Sheets

CLEANING METHOD

CROSS-REFERENCE TO RELATED APPLICATIONS

This application is a continuation application of U.S. patent application Ser. No. 12/295,671 filed on Apr. 4, 2007, which in turn was filed under the provisions of 35 U.S.C. §371 and claims the priority of International Patent Application No. PCT/GB07/01235 filed on Apr. 4, 2007, which in turn claims priority of Great Britain Application No. 0607047.8 filed on Apr. 7, 2006, the contents of all applications are incorporated by reference herein for all purposes.

FIELD OF THE INVENTION

The present invention relates to the treatment of substrates. More specifically, the invention is concerned with a novel method for the cleaning of substrates which involves the use of a solvent-free cleaning treatment, and thereby eliminates the environmental issues which are associated with solvent processing, but also resembles dry cleaning in that it requires the use of only limited quantities of water. Most particularly, the invention is concerned with the cleaning of textile fibres.

BACKGROUND TO THE INVENTION

Dry cleaning is a process of major importance within the textile industry, specifically for the removal of hydrophobic stains which are difficult to remove by traditional aqueous washing methods. However, most commercial dry cleaning systems currently employ toxic and potentially environmentally harmful halocarbon solvents, such as perchloroethylene. The use of these solvents, and the need for their storage, treatment, and/or disposal creates major effluent problems for the industry, and this inevitably increases costs.

More recently, the use of carbon dioxide as an alternative to such systems has been reported. Thus, systems which employ liquid carbon dioxide in combination with surfactants containing a $CO_2$-philic functional moiety have been proposed, whilst the use of more conventional surfactants in combination with supercritical carbon dioxide has also been disclosed. However, a major problem with carbon dioxide is its lower solvent power relative to other solvents. Furthermore, some of the procedures rely on the use of high pressure systems, and this is a clear disadvantage, since it presents an inherent safety risk, thereby lessening the attractiveness of the procedures.

In the light of the difficulties and disadvantages associated with traditional dry cleaning processes, the present inventors have attempted to devise a new and inventive approach to the problem, which allows the deficiencies demonstrated by the methods of the prior art to be overcome. Thus, the present invention seeks to provide a process for the dry cleaning of substrates, particularly for the dry cleaning of textile fibres, which eliminates the requirement for the use of either potentially harmful solvents or carbon dioxide in either the liquid or supercritical state, but which is still capable of providing an efficient means of cleaning and stain removal, whilst also yielding economic and environmental benefits.

The dry cleaning process, whilst being dependent on the use of solvents, does also incorporate aqueous media within the cleaning process, since fabrics and garments which are subjected to dry cleaning will inevitably contain significant amounts of water, which generally becomes entrapped therein by absorption or adsorption from the atmosphere. On occasions, further wetting of the fabrics or garments prior to dry cleaning may be desirable. However, the cleaning formulation used in conventional dry cleaning processes does not include added quantities of aqueous media therein and, in this way, dry cleaning differs from standard washing procedures. In the present invention, the cleaning process employs a cleaning formulation which is essentially free of organic solvents and requires the use of only limited amounts of water, thereby offering significant environmental benefits.

STATEMENTS OF INVENTION

Thus, according to a first aspect of the present invention, there is provided a method for cleaning a soiled substrate, said method comprising the treatment of the moistened substrate with a formulation comprising a multiplicity of polymeric particles, wherein said formulation is free of organic solvents.

Said substrate may comprise any of a wide range of substrates, including, for example, plastics materials, leather, paper, cardboard, metal, glass or wood. In practice, however, said substrate most preferably comprises a textile fibre, which may be either a natural fibre, such as cotton, or a synthetic textile fibre, for example nylon 6,6 or a polyester.

Said polymeric particles may comprise any of a wide range of different polymers. Specifically, there may be mentioned polyalkenes such as polyethylene and polypropylene, polyesters and polyurethanes. Preferably, however, said polymeric particles comprise polyamide particles, most particularly particles of nylon, most preferably in the form of nylon chips. Said polyamides are found to be particularly effective for aqueous stain/soil removal, whilst polyalkenes are especially useful for the removal of oil-based stains. Optionally, copolymers of the above polymeric materials may be employed for the purposes of the invention.

Whilst, in one embodiment, the method of the invention envisages the cleaning of a soiled substrate by the treatment of a moistened substrate with a formulation which essentially consists only of a multiplicity of polymeric particles, in the absence of any further additives, optionally in other embodiments the formulation employed may additionally comprise at least one cleaning material. Preferably, the at least one cleaning material comprises at least one surfactant. Preferred surfactants comprise surfactants having detergent properties. Said surfactants may comprise anionic, cationic and/or non-ionic surfactants. Particularly preferred in the context of the present invention, however, are non-ionic surfactants. Optionally, said at least one cleaning material is mixed with said polymeric particles but, in a preferred embodiment, each of said polymeric particles is coated with said at least one cleaning material.

Various nylon homo- or co-polymers may be used, including Nylon 6 and Nylon 6,6. Preferably, the nylon comprises Nylon 6,6 homopolymer having a molecular weight in the region of from 5000 to 30000 Daltons, preferably from 10000 to 20000 Daltons, most preferably from 15000 to 16000 Daltons.

The polymeric particles or chips are of such a shape and size as to allow for good flowability and intimate contact with the textile fibre. Preferred shapes of particles include spheres and cubes, but the preferred particle shape is cylindrical. Particles are preferably of such a size as to have an average weight in the region of 20-50 mg, preferably from 30-40 mg. In the case of the most preferred cylindrically shaped chips, the preferred average particle diameter is in the region of from 1.5-6.0 mm, more preferably from 2.0-5.0 mm, most preferably from 2.5-4.5 mm, and the length of the cylindrical chips is preferably in the range from 2.0-6.0 mm, more preferably from 3.0-5.0 mm, and is most preferably in the region of 4.0 mm.

The method of the invention may be applied to a wide variety of substrates as previously stated. More specifically, it is applicable across the range of natural and synthetic textile fibres, but it finds particular application in respect of nylon 6,6, polyester and cotton fabrics.

Prior to treatment according to the method of the invention, the substrate is moistened by wetting with water, to provide additional lubrication to the cleaning system and thereby improve the transport properties within the system. Thus, more efficient transfer of the at least one cleaning material to the substrate is facilitated, and removal of soiling and stains from the substrate occurs more readily. Most conveniently, the substrate may be wetted simply by contact with mains or tap water.

Preferably, the wetting treatment is carried out so as to achieve a substrate to water ratio of between 1:0.1 to 1:5 w/w; more preferably, the ratio is between 1:0.2 and 1:2, with particularly favourable results having been achieved at ratios such as 1:0.2, 1:1 and 1:2. However, in some circumstances, successful results can be achieved with substrate to water ratios of up to 1:50, although such ratios are not preferred in view of the significant amounts of effluent which are generated.

The method of the invention has the advantage that, other than this aqueous treatment, it is carried out in the absence of added solvents—most notably in the absence of organic solvents—and, consequently, it shows distinct advantages over the methods of the prior art in terms of safety and environmental considerations, as well as in economic terms. However, whilst the formulation employed in the claimed method is free of organic solvents, in that no such solvents are added to the formulation, it will be understood that trace amounts of such solvents may inevitably be present in the polymeric particles, the substrate, the water, or other additives, such as cleaning materials, so it is possible that the cleaning formulations and baths may not be absolutely free of such solvents. However, such trace amounts are insignificant in the context of the present invention, since they do not have any impact on the efficiency of the claimed process, nor do they create a subsequent effluent disposal problem and the formulation is, therefore, seen to be essentially free of organic solvents.

According to a second aspect of the present invention, there is provided a formulation for cleaning a soiled substrate, said formulation comprising a multiplicity of polymeric particles. In one embodiment, said formulation may essentially consist only of said multiplicity of polymeric particles, but optionally in other embodiments said formulation additionally comprises at least one cleaning material. Said formulation is preferably used in accordance with the method of the first aspect of the invention, and is as defined in respect thereof. Additional additives may be incorporated in said formulation, as appropriate.

The formulation and the method of the present invention may be used for either small or large scale processes of both the batchwise and continuous variety and, therefore, finds application in both domestic and industrial cleaning processes. Particularly favourable results are achieved when the method of the invention is carried out in apparatus or containers which encourage Newtonian Flow. Optimum performance frequently results from the use of fluidised beds, and this is particularly the case when the method of the invention is used for carrying out dry cleaning processes.

DESCRIPTION OF THE INVENTION

Figure 1:
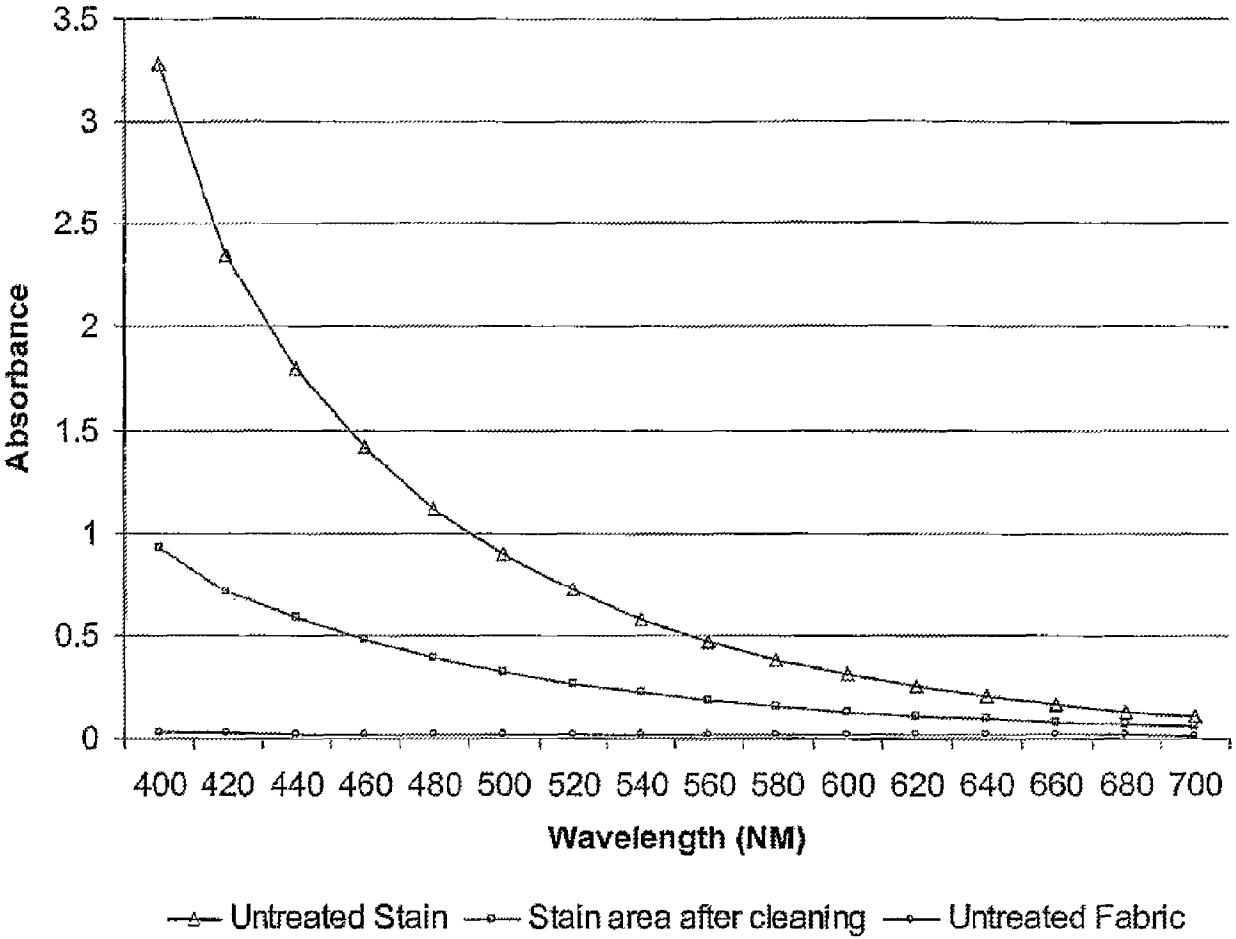
FIG. 1 shows the reduction in stain of pre-soiled mercerized cotton fabric after cleaning according to the method of Example 2.

In the method according to the first aspect of the invention, which is known as the interstitial method of cleaning or scouring, the ratio of beads to substrate is based on a nominal "liquor ratio" in terms of a conventional dry cleaning system, with the preferred ratio being in the range of from 30:1 to 1:1 w/w, preferably in the region of from 20:1 to 10:1 w/w, with particularly favourable results being achieved with a ratio of around 15:1 w/w. Thus, for example, for the cleaning of 5 g of fabric, 75 g of polymeric particles, optionally coated with surfactant, would be employed.

As previously noted, the method of the invention finds particular application in the cleaning of textile fibres. The conditions employed in such a cleaning system are very much in line with those which apply to the conventional dry cleaning of textile fibres and, as a consequence, are generally determined by the nature of the fabric and the degree of soiling. Thus, typical procedures and conditions are in accordance with those which are well known to those skilled in the art, with fabrics generally being treated according to the method of the invention at, for example, temperatures of between 30 and 90° C. for a duration of between 20 minutes and 1 hour, then being rinsed in water and dried.

In the embodiment of the invention wherein the formulation comprises at least one cleaning material, it is preferred that the polymeric particles should be coated with the at least one surfactant, in order to achieve a more level distribution of the said surfactant on the particles and, consequently, on the substrate, as the particles contact the substrate during the cleaning process. Typically, this coating process requires that the polymeric particles should be mixed with 0.5%-10%, preferably 1%-5%, most preferably around 2% of the at least one surfactant, and the resulting mixture held at a temperature of between 30° and 70° C., preferably 40° and 60° C., most preferably in the region of 50° C., for a time of between 15 and 60 minutes, preferably between 20 and 40 minutes, with the most satisfactory results being obtained when the treatment is carried out for approximately 30 minutes.

The results obtained are very much in line with those observed when carrying out conventional dry cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The method also finds application in wash-off procedures applied to textile fibres subsequent to dyeing processes, and in scouring processes which are used in textile processing for the removal of dirt, sweat, machine oils and other contaminants which may be present following processes such as spinning and weaving. No problems are observed with polymer particles adhering to the fibres at the conclusion of the cleaning process. Furthermore, of course, as previously observed, the attendant drawbacks associated with the use of solvents in conventional dry cleaning processes, in terms of both cost and environmental considerations, are avoided, whilst the volumes of water required are significantly lower than those associated with the use of conventional washing procedures.

Additionally, it has been demonstrated that re-utilisation of the polymer particles is possible, and that particles can be satisfactorily re-used in the cleaning procedure, although some deterioration in performance is generally observed following three uses of the particles. When re-using particles, optimum results are achieved when using particles coated with the at least one coating material which are then re-coated prior to re-use.

The method of the invention will now be exemplified, though without in any way limiting the scope of the invention, by reference to the following examples:

EXAMPLES

Example 1

The polymer particles comprised cylindrical nylon chips comprising Nylon 6,6 polymer having a molecular weight in the region of 15000-16000 Daltons, with average dimensions of 4 mm in length and 2-3 mm in diameter, and an average particle weight of 30-40 mg.

The fabric to be cleaned comprised soiled and stained Nylon 6,6 fibres, and the wetted dyed fabric was entered into the dry cleaning bath at 40° C. and the temperature was maintained at 40° C. for 10 minutes, then increased to 70° C. at a rate of 2° C. per minute, and then maintained at 70° C. for 20 minutes, after which time the fabric was removed, rinsed and dried. Complete removal of the soiling and staining was achieved.

Example 2

The fabric to be cleaned comprised a soiled cloth of mercerised cotton stained with coffee in an aqueous transport medium, the cloth having an air dry mass of 5 g. This pre-soiled fabric sample was placed in a 2 liter sealed container with 75 g (air dry mass) of polymer particles comprising cylindrical chips of Nylon 6,6 polymer, with average dimensions of 4 mm in length and 4 mm in diameter. The pre-soiled fabric sample was wetted with tap water before commencement of cleaning to give a substrate to water ratio of 1:1. The sealed container was 'tumbled'/rotated for 30 minutes to a maximum of 70° C. with a cooling stage at the end of the cycle. Once cleaned, the fabric was removed from the sealed container and dried flat. The colour change to the stained area after cleaning was measured spectrophotometrically and is illustrated in FIG. 1, from which it is apparent that the degree of staining was very significantly reduced following the cleaning process.

Example 3

Figure 2:
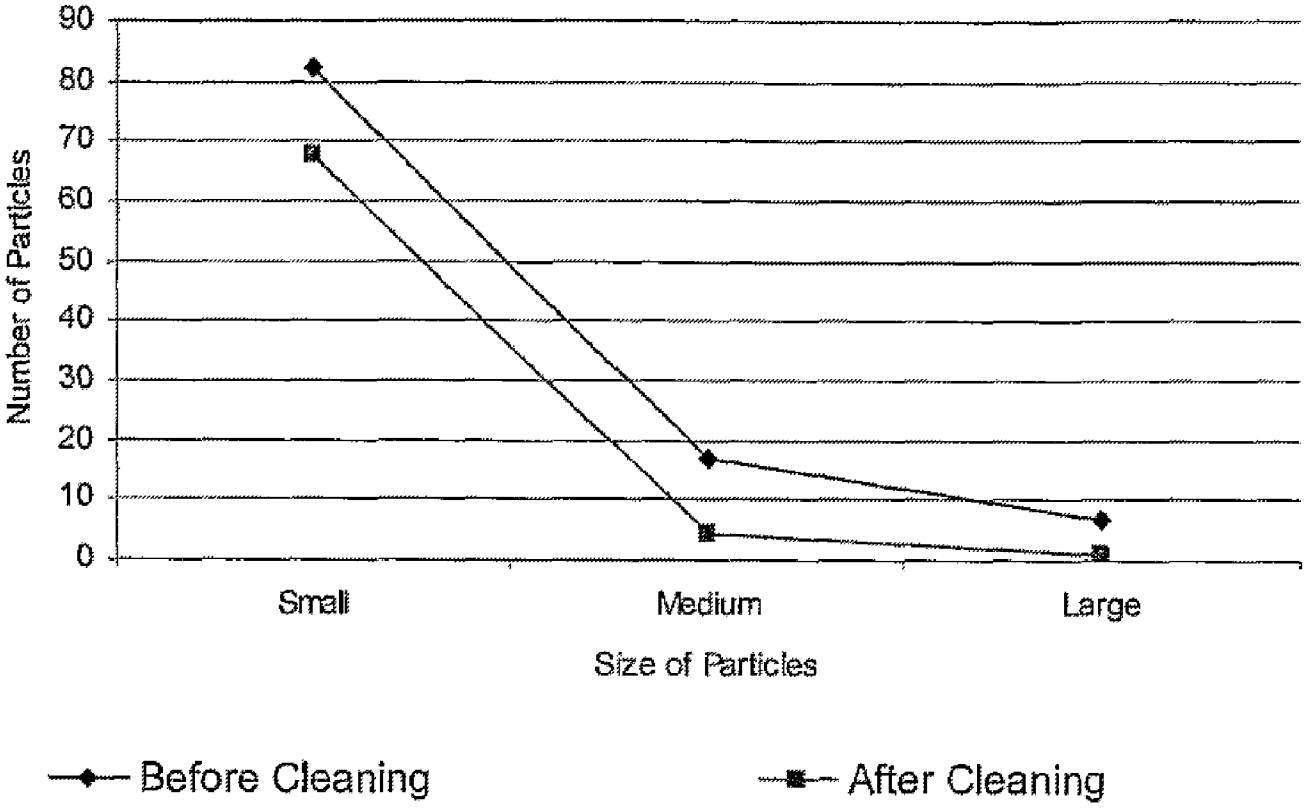
FIG. 2 shows the reduction in numbers of soil particles (10× magnification) in pre-soiled mercerized cotton fabric after cleaning according to the method of Example 3.

The fabric to be cleaned comprised a soiled cloth of mercerised cotton stained with city street dirt in an aqueous transport medium, the cloth having an air dry mass of 5 g. This pre soiled fabric sample is placed in a 2 liter sealed container with 75 g (air dry mass) of polymer particles comprising cylindrical chips of Nylon 6,6 polymer, with average dimensions of 4 mm in length and 4 mm in diameter. The pre-soiled fabric sample was wetted with tap water before commencement of cleaning to give a substrate to water ratio of 1:2. The sealed container was 'tumbled'/rotated for 30 minutes to a maximum of 70° C. with a cooling stage at the end of the cycle. Once cleaned, the fabric was removed from the sealed container and dried flat. The degree of removal of particulate stain after cleaning was determined by microscopy and is illustrated in FIG. 2, from which it can be seen that a significant reduction in numbers of dirt particles was observed after the cleaning process had taken place.

Example 4

The fabrics to be cleaned comprised soiled cloths (cotton and polyester stained with coffee, soil, boot polish, ball point pen, lipstick, tomato ketchup and grass) with an air dry mass of 5 g. Each pre-soiled fabric sample was placed in a 2 liter sealed container with 75 g (air dry mass) of the polymer particles (cylindrical nylon chips comprising nylon 6,6 polymer, with average dimensions of 4 mm in length and 4 mm in diameter). Each pre-soiled fabric sample was wetted with mains or tap water before cleaning commenced to give a substrate to water ratio of 1:1. The sealed container was 'tumbled'/rotated for 30 minutes at a maximum temperature of 70° C. with a cooling stage at the end of the cycle. Once cleaned, the fabric was then removed from the sealed container and dried flat. In each case, the colour change to the stained area can be seen from the change in colour difference using ΔE* and CIEDE2000 (1:1), and the colour difference measurements for the Lab* values are also included in Tables 1 and 2.

TABLE 1

Colour difference for stain removal by the interstitial cleaning method for cotton fabric using the method of Example 4

| Sample | DL* | Da* | Db* | ΔE* | CIE2000 DE |
|---|---|---|---|---|---|
| Soil | 21.48 | −0.57 | 0.20 | 21.49 | 16.59 |
| Coffee | 7.53 | −2.86 | −7.45 | 10.97 | 6.99 |
| Boot polish | 7.41 | 0.09 | 0.32 | 7.42 | 5.96 |
| Ball point pen | −4.86 | 1.93 | −7.82 | 9.41 | 8.05 |
| Lipstick | 21.54 | −19.34 | −10.07 | 30.65 | 19.92 |
| Tomato ketchup | −3.03 | 2.32 | −8.63 | 9.44 | 6.26 |
| Grass | −4.17 | 4.10 | −4.87 | 7.60 | 5.30 |

TABLE 2

Colour difference for stain removal by the interstitial cleaning method for polyester fabric using the method of Example 4

| Sample | DL* | Da* | Db* | ΔE* | CIE2000 DE |
|---|---|---|---|---|---|
| Soil | 16.15 | −0.63 | −0.26 | 16.16 | 11.78 |
| Coffee | 13.90 | −6.53 | −12.30 | 19.68 | 13.08 |
| Boot polish | 2.28 | 0.16 | −0.15 | 2.29 | 1.84 |
| Ball point pen | 17.66 | 0.66 | −1.31 | 17.72 | 14.06 |
| Lipstick | 23.79 | −15.45 | −6.92 | 29.20 | 21.25 |
| Tomato ketchup | 7.77 | −2.56 | −21.66 | 23.16 | 12.68 |
| Grass | −0.74 | 1.20 | −1.17 | 1.83 | 1.92 |

Example 5

Figure 3:
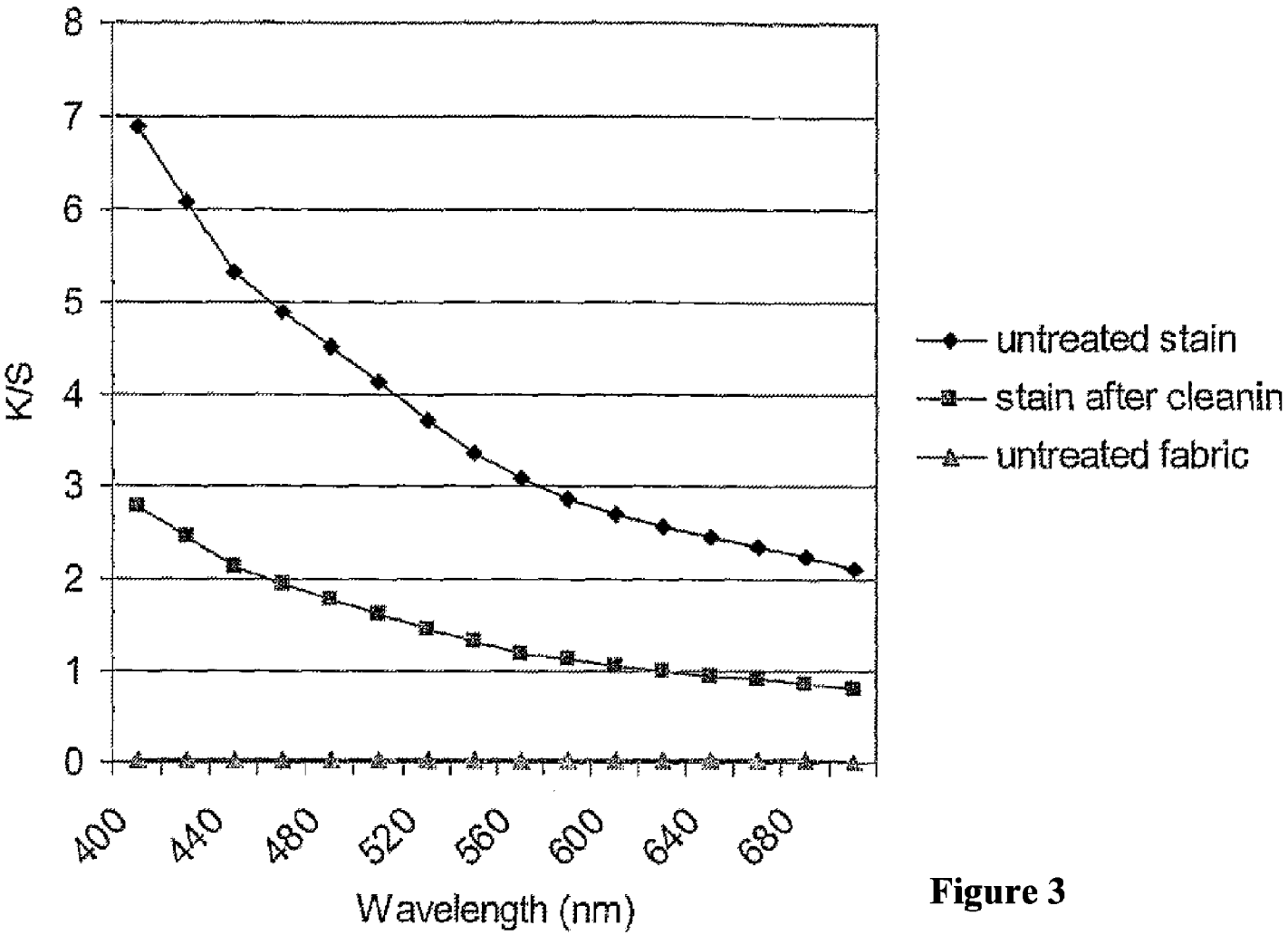
FIG. 3 shows the change in colour strength illustrating extent of stain removal from soiled cotton fabric after cleaning according to the method of Example 5.

The fabric to be cleaned comprised a soiled cloth (cotton stained with city street dirt in an aqueous transport medium) with an air dry mass of 5 g. This pre soiled fabric sample was placed in a 2 liter sealed container with 75 g (air dry mass) of the polymer particles (cylindrical nylon chips comprising nylon 6,6 polymer, with average dimensions of 4 mm in length and 4 mm in diameter). The pre-soiled fabric sample was wetted with mains or tap water before cleaning commenced to give a substrate to water ratio of 1:2. The sealed container was 'tumbled'/rotated for 30 minutes to a maximum temperature of 70° C. with a cooling stage at the end of the cycle. Once cleaned, the fabric was then removed from the sealed container and dried flat. The amount of removal was measured in the change in colour strength values between the fabric before and after cleaning, as shown by the change in K/S values seen in FIG. 3.

Example 6

The fabric to be cleaned comprised a soiled cloth (cotton stained with boot polish, soil, coffee and tomato ketchup) with an air dry mass of 1 kg. This pre-soiled fabric sample was placed in a sealed container with 15 kg (air dry mass) of the polymer particles (cylindrical nylon chips comprising nylon 6,6 polymer, with average dimensions of 4 mm in length and 4 mm in diameter). The pre-soiled fabric sample was wetted with mains or tap water before cleaning commenced to give a substrate to water ratio of 1:0.2. The sealed container was 'tumbled'/rotated for 30 minutes to a maximum temperature of 70° C. with a cooling stage at the end of the cycle. Once cleaned, the fabric was then removed from the sealed container and dried. In each case, the colour change to the stained area can be seen from the change in colour difference using ΔE* and CIEDE2000 (1:1) colour difference measurements, as shown in Table 3.

TABLE 3

Colour difference for stain removal by the interstitial cleaning method for cotton fabric using the method of Example 6

| Fabric samples | Colour difference. CIELAB DE | CIE2000 DE (1:1) |
|---|---|---|
| Untreated boot polish stain to Cleaned boot polish stain | 9.7216 | 7.8725 |
| Untreated dirt stain to Cleaned dirt stain | 45.3258 | 45.0107 |
| Untreated ketchup stain to Cleaned ketchup stain | 14.3544 | 9.2786 |
| Untreated coffee stain to Cleaned coffee stain | 5.9278 | 4.0275 |

Example 7

Figure 4:
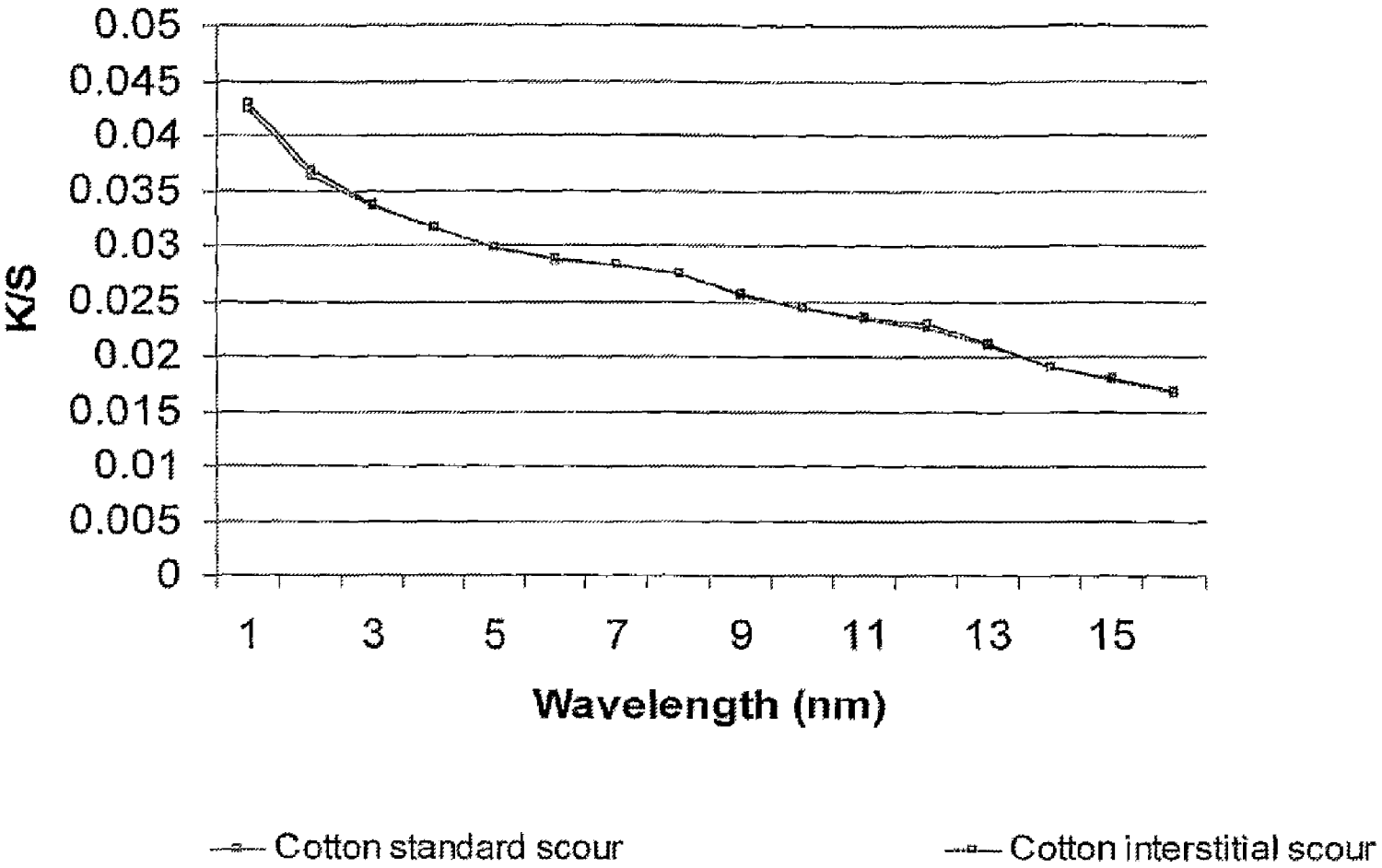
FIG. 4 shows the change in colour strength illustrating extent of removal of coloured materials from soiled cotton fabric after scouring according to the method of Example 7.

The fabric to be scoured comprised a greige cotton cloth with an air dry mass of 5 g. This greige fabric sample was placed in a 2 liter sealed container with 75 g (air dry mass) of the polymer particles (cylindrical nylon chips comprising nylon 6,6 polymer, with average dimensions of 4 mm in length and 4 mm in diameter). The greige fabric sample was wetted with mains or tap water before cleaning commenced to give a substrate to water ratio of 1:2. The sealed container was 'tumbled'/rotated for 30 minutes to a maximum temperature of 70° C. with a cooling stage at the end of the cycle. Once cleaned the fabric was then removed from the sealed container and dried flat. The difference in colour between conventionally scoured fabric and the fabric cleaned using the novel process was assessed by the change in colour strength values between the fabrics shown by the change in K/S values seen in FIG. 4.

That which is claimed is:

1. A method for cleaning a soiled substrate, said method comprising treating of the soiled substrate with water to provide a premoistened soiled substrate and treating the premoistened soiled substrate with a formulation comprising a multiplicity of polymeric particles, wherein said formulation is free of organic solvents, wherein said formulation comprises at least one cleaning material selected from anionic, cationic and non-ionic surfactants, wherein said polymeric particles comprise polyamide, polyesters or polyurethanes, or their copolymers, wherein said polymeric particles are reused in further cleaning procedures according to the method, wherein the soiled substrate comprises a textile fiber, and wherein said particles to said textile fiber is in a ratio of from 30:1 to 1:1 w/w.

2. The method as claimed in claim 1 wherein said textile fiber comprises cotton, nylon 6,6 or a polyester.

3. The method as claimed in claim 1 wherein said soiled substrate is wetted by contact with mains or tap water.

4. The method as claimed in claim 3 wherein said soiled substrate is wetted so as to achieve a substrate to water ratio of between 1:0.1 to 1:5 w/w.

5. The method as claimed in claim 1, wherein said at least one cleaning material is mixed with said polymeric particles.

6. The method as claimed in claim 1, wherein each of said polymeric particles is coated with said at least one cleaning material.

7. The method as claimed in claim 6 wherein said polymeric particles are coated with said cleaning material by mixing with 0.5%-10% of the material.

8. The method as claimed in claim 6 wherein said polymeric particles are coated with said cleaning material by mixing with said material and the resulting mixture is held at a temperature of between 30° and 70° C.

9. The method as claimed in claim 8 wherein said polymeric particles are coated with said cleaning material by mixing with said material at said temperature for a time of between 15 and 60 minutes.

10. The method as claimed in claim 1 wherein said polyamide particles comprise particles of nylon.

11. The method as claimed in claim 10 wherein said particles of nylon comprise nylon chips.

12. The method as claimed in claim 10 wherein said nylon comprises Nylon 6 or Nylon 6,6.

13. The method as claimed in claim 1 wherein said particles are in the shape of cylinders, spheres or cubes.

14. The method as claimed in claim 13 wherein said cylindrically shaped particles have an average particle diameter in the region of from 1.5 to 6.0 mm.

15. The method as claimed in claim 14 wherein the length of said cylindrical particles is in the range of from 2.0 to 6.0 mm.

16. The method as claimed in claim 1 wherein said particles have an average weight in the region of from 20 to 50 mg.

17. The method as claimed in claim 1 which comprises a continuous process or a batchwise process.

18. The method as claimed in claim 1 wherein said method is carried out in an apparatus or container which encourages Newtonian Flow.

19. The method as claimed in claim 18 wherein said process is carried out in a fluidized bed.

20. The method as claimed in claim 1 wherein said treatment is carried out at a temperature of between 30 and 90° C.

21. The method as claimed in claim 20 wherein said treatment is carried out for a duration of between 20 minutes and 1 hour.

22. A method for cleaning a soiled substrate, said method comprising treating of the soiled substrate with water to provide a premoistened soiled substrate and treating the premoistened soiled substrate with a formulation comprising a multiplicity of polymeric particles, wherein said formulation is free of organic solvents, wherein said polymeric particles comprise polyamide, polyesters or polyurethanes, or their copolymers, wherein said polymeric particles are re-used in further cleaning procedures according to the method, wherein the soiled substrate comprises a textile fiber, and wherein said particles to said textile fiber is in a ratio of from 30:1 to 1:1 w/w.

23. The method as claimed in claim 22 wherein said polyamide particles comprise nylon.

24. The method as claimed in claim 23 wherein said particles of nylon comprise nylon chips.

25. The method as claimed in claim 23 wherein said nylon comprises Nylon 6 or Nylon 6,6.

26. The method as claimed in claim 22 wherein said textile fiber comprises cotton, nylon 6,6 or a polyester.

27. The method as claimed in claim 22 wherein said soiled substrate is wetted by contact with mains or tap water.

28. The method as claimed in claim 27 wherein said soiled substrate is wetted so as to achieve a substrate to water ratio of between 1:0.1 to 1:5 w/w.

29. The method as claimed in claim 22 wherein said formulation additionally comprises at least one cleaning material.

30. The method as claimed in claim 29, wherein said at least one cleaning material is mixed with said polymeric particles.

31. The method as claimed in claim 29 wherein each of said polymeric particles is coated with said at least one cleaning material.

32. The method as claimed in claim 31 wherein said polymeric particles are coated with said cleaning material by mixing with 0.5%-10% of the material.

33. The method as claimed in claim 31 wherein said polymeric particles are coated with said cleaning material by mixing with said material and the resulting mixture is held at a temperature of between 30° and 70° C.

34. The method as claimed in claim 33 wherein said polymeric particles are coated with said cleaning material by mixing with said material at said temperature for a time of between 15 and 60 minutes.

35. The method as claimed in claim 22 wherein said particles are in the shape of cylinders, spheres or cubes.

36. The method as claimed in claim 35 wherein said cylindrically shaped particles have an average particle diameter in the region of from 1.5 to 6.0 mm.

37. The method as claimed in claim 36 wherein the length of said cylindrical particles is in the range of from 2.0 to 6.0 mm.

38. The method as claimed in claim 22 wherein said particles have an average weight in the region of from 20 to 50 mg.

39. The method as claimed in claim 22 which comprises a continuous process or a batchwise process.

40. The method as claimed in claim 22 wherein said method is carried out in an apparatus or container which encourages Newtonian Flow.

41. The method as claimed in claim 40 wherein said process is carried out in a fluidized bed.

42. The method as claimed in claim 22 wherein said treatment is carried out at a temperature of between 30 and 90° C.

43. The method as claimed in claim 42 wherein said treatment is carried out for a duration of between 20 minutes and 1 hour.

* * * * *